US010201732B2

(12) United States Patent
Ahmed

(10) Patent No.: US 10,201,732 B2
(45) Date of Patent: Feb. 12, 2019

(54) BALL WITH DOMED PANELS

(71) Applicant: Mohammed Ejaz Ahmed, Glenmont, NY (US)

(72) Inventor: Mohammed Ejaz Ahmed, Glenmont, NY (US)

( * ) Notice: Subject to any disclaimer, the term of this patent is extended or adjusted under 35 U.S.C. 154(b) by 0 days.

(21) Appl. No.: 15/802,532

(22) Filed: Nov. 3, 2017

(65) Prior Publication Data

US 2018/0161636 A1 Jun. 14, 2018

Related U.S. Application Data

(63) Continuation-in-part of application No. 15/379,382, filed on Dec. 14, 2016, now Pat. No. 10,112,082, and a continuation-in-part of application No. 15/421,336, filed on Jan. 31, 2017, now Pat. No. 9,919,189.

(51) Int. Cl.
*A63B 41/08* (2006.01)
*A63B 45/00* (2006.01)

(52) U.S. Cl.
CPC ..... *A63B 41/08* (2013.01); *A63B 45/00* (2013.01); *A63B 2243/0025* (2013.01); *A63B 2243/0033* (2013.01)

(58) Field of Classification Search
CPC . A63B 41/08; A63B 45/00; A63B 2243/0033; A63B 2243/0025; A63B 41/02; A63B 41/085; A63B 41/10
See application file for complete search history.

(56) References Cited

U.S. PATENT DOCUMENTS

| | | | | |
|---|---|---|---|---|
| 4,462,590 | A * | 7/1984 | Mitchell | A63B 41/08 273/DIG. 8 |
| 4,660,831 | A * | 4/1987 | Kralik | A63B 41/00 473/603 |
| 5,772,545 | A * | 6/1998 | Ou | A63B 41/00 156/170 |
| 6,039,662 | A * | 3/2000 | Chan | A63B 41/08 473/599 |
| 6,220,979 | B1 | 4/2001 | Chan | |
| 6,503,162 | B1 * | 1/2003 | Shishido | A63B 41/08 473/599 |
| 6,514,164 | B1 | 2/2003 | Parrett | |
| 7,645,203 | B2 | 1/2010 | Tang et al. | |
| 7,753,813 | B2 * | 7/2010 | Taniguchi | A63B 41/00 473/605 |
| 8,926,459 | B2 * | 1/2015 | Berggren | A63B 41/00 473/604 |
| 9,011,621 | B1 | 4/2015 | Hussain | |
| 9,101,802 | B2 | 7/2015 | Hussain | |
| 9,186,559 | B1 | 11/2015 | Hussain | |
| 9,586,098 | B1 | 3/2017 | Ahsan | |

(Continued)

*Primary Examiner* — Steven Wong
(74) *Attorney, Agent, or Firm* — Lawrence D. Cutter, Esq.

(57) ABSTRACT

A ball for sports play such as a soccer ball comprises three layers: a standard outer cover layer and a standard inner or bladder layer along with an intermediate layer of panels. These panels have three portions: a portion and extending into recesses formed by stitching together of the outer panels; a middle portion extending on the inside over the stitching; and a third portion which is disposed between the bladder and the middle portion having a size position and extent sufficient to produce elevations in the central areas of exterior panels in the outer cover layer.

9 Claims, 18 Drawing Sheets

(56) References Cited

U.S. PATENT DOCUMENTS

| | | | | |
|---|---|---|---|---|
| 9,682,286 | B2 * | 6/2017 | Shishido | A63B 41/08 |
| 9,919,189 | B1 * | 3/2018 | Ahmed | A63B 41/08 |
| 2002/0086749 | A1 * | 7/2002 | Ou | A63B 41/00 473/604 |
| 2003/0073527 | A1 * | 4/2003 | Ou Chen | A63B 41/00 473/604 |
| 2003/0228946 | A1 | 12/2003 | Chan | |
| 2005/0277499 | A1 * | 12/2005 | Tang | A63B 41/085 473/604 |
| 2006/0046880 | A1 * | 3/2006 | Tang | A63B 41/08 473/604 |
| 2009/0325745 | A1 * | 12/2009 | Rapaport | A63B 39/00 473/604 |
| 2010/0167850 | A1 * | 7/2010 | Lin | A63B 41/00 473/605 |
| 2013/0260927 | A1 | 10/2013 | Thurman et al. | |

* cited by examiner

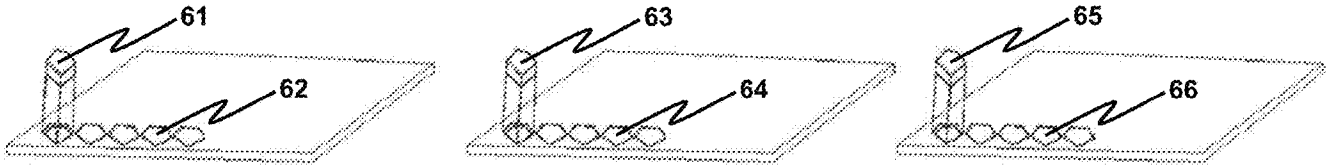
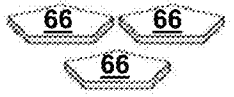
Fig. 11C
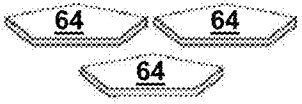
Fig. 11B
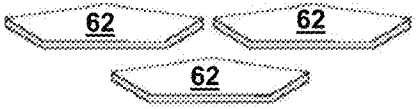
Fig. 11A
Fig. 13A
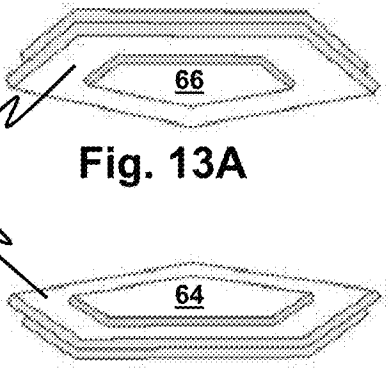
Fig. 13B
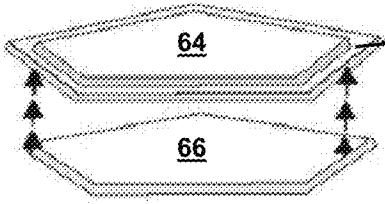
Fig. 12B
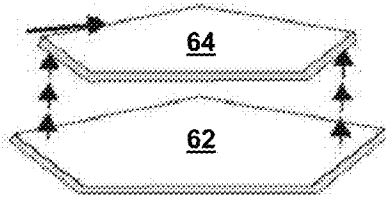
Fig. 12A

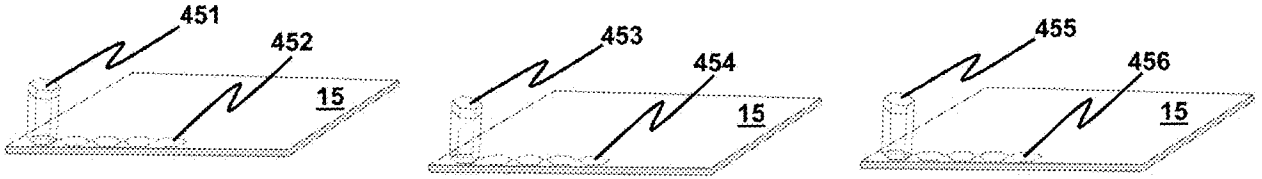
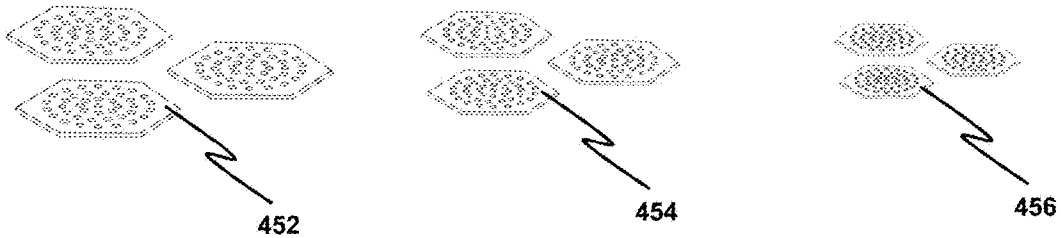
Fig. 34A
Fig. 34B
Fig. 34C
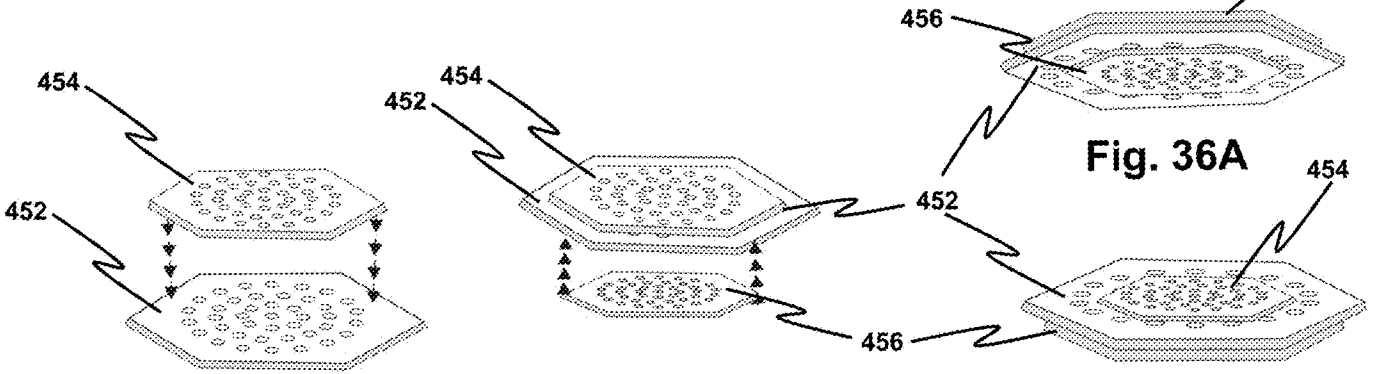
Fig. 35A
Fig. 35B
Fig. 36A
Fig. 36B

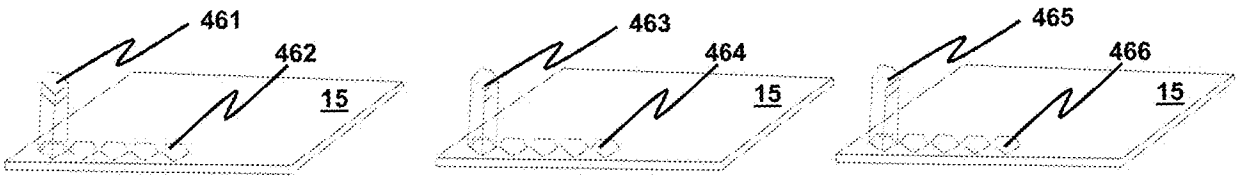
Fig. 37A
Fig. 37B
Fig. 37C
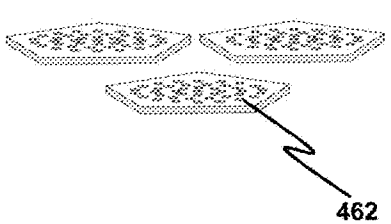
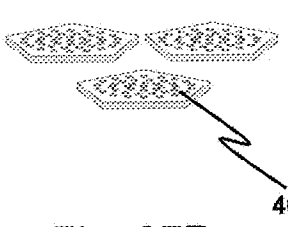
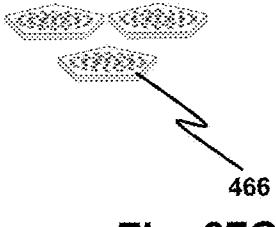
Fig. 38A
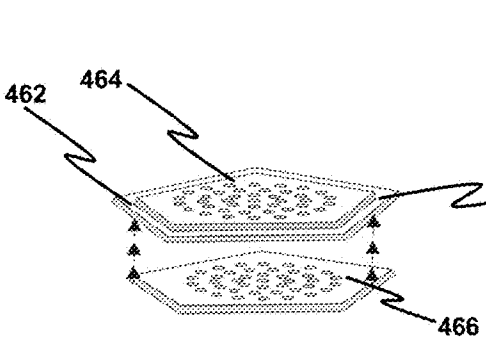
Fig. 38B
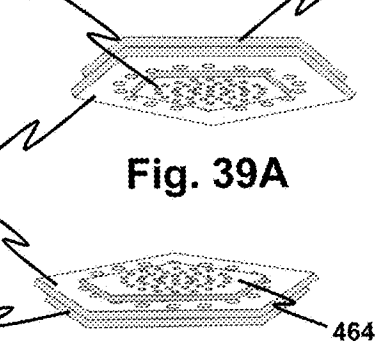
Fig. 39A
Fig. 39B

BALL WITH DOMED PANELS

CROSS-REFERENCE TO RELATED APPLICATIONS

This application contains subject matter which is related to the subject matter of the following applications, each of which is assigned to the same assignee as this application. Each of the below listed applications is hereby incorporated herein by reference in its entirety:

Application Ser. No. 15/379,382 filed Dec. 14, 2016 titled Ball with Increased Flexure;

Application Ser. No. 15/421,336 filed Jan. 31, 2017 titled Ball with Increased Flexure and Gel Fill.

TECHNICAL FIELD

The invention described herein is generally directed to balls for sports activities. More particularly, the invention is directed to balls used for playing soccer and handball. The present application differs from previously submitted parent applications in several respects but most notably, the presently claimed invention employs a plurality of interior panels disposed just beneath the exterior panels so as to provide a more rounded or dome-shaped structure to the individual panels, especially when inflated. Even more particularly, the present invention is directed to soccer balls and handballs having a layer of fabric disposed below individual panels.

It should be particularly noted that references made herein to handballs do not refer to the small hard balls used in games such as indoor court based American handball. The handball referred to herein is known as team handball or Olympic handball which is a team sport in which two teams of seven players each (six outfield players and a goalkeeper) pass a ball using their hands with the aim of throwing it into the goal of the other team.

BACKGROUND OF THE INVENTION

Soccer and similar games are extremely popular. As with any sporting enterprise, improvements in the level of play are perpetually sought after both by the physical capabilities of the athletes themselves and also by improvements in the equipment used to play. In particular, for soccer and similar sports improvements in the speed of the ball are desirable. Aerodynamic friction with surrounding air is always an aspect that is desirable of reduction. Reduced air friction for a soccer ball means a livelier level of play and a faster and more challenging game.

As with soccer and similar sporting activities, it is always desirable to be able to improve the contact or interaction between the player and the ball. As with any sphere like playing object, particularly ones that are the size of soccer balls, it is generally difficult for a player to easily grip the ball. This can mean fumbles and errors in play none of which are desirable in sporting competitions.

Since soccer balls and similar sporting objects are subject to rough handling including being kicked, it is also desirable to provide them with as much strength as possible. It is noted that soccer balls, like many sporting objects, are comprised of a plurality of individual panels that are sewn together. By choosing various shapes for the panels, differently shaped sporting objects are created. For ease of discussion, it is noted that references made herein to "balls" or "soccer balls" are intended to refer to the broad class of sporting objects in general and in particular to those sporting objects that comprise a plurality of stitched together panels. Accordingly, it is seen that improvements in structure and construction are desirable to counteract the abuse that is sustained by sporting objects. Even more particularly, specific reference to inflatable sporting objects, it is desirable that sufficiently strong and durable connections be made between an internal, inflatable bladder and the exterior portion of the ball.

From the above, it is therefore seen that there exists a need in the art to overcome the deficiencies and limitations described herein and above.

SUMMARY OF THE INVENTION

It should be appreciated that this Summary is provided to introduce a selection of concepts in a simplified form that are further described below in the Detailed Description. This Summary is not intended to be used to limit the scope of the claimed subject matter.

The shortcomings of the prior art are overcome and additional advantages are provided through the construction and use of an object for sports play which comprises: a plurality of exterior, stitched together panels (the visible cover of the sporting object) sewn at their edges and configured to form a closed volume which forms, by the stitching, raised interior edges at the edges of these panels. This construction naturally results in each of these panels having associated therewith a recessed area that is essentially coextensive with the panel and defined by raised interior edges produced by the stitching. This stitching results in regions along the edges of the joined panels which are harder and usually have a more jarring effect on the players. The sporting object also includes an inflatable bladder which fills the enclosed volume when inflated. The ball of the present invention also includes a first plurality of interior panels that are disposed between the bladder and the exterior panels. The first plurality of panels are essentially coextensive with the respective recessed areas that are defined by the stitching between adjacent panels. Moreover, and very desirable for the present invention, the peripheral regions of this first plurality of panels is disposed over the stitching. This provides cushioning against the above-mentioned jarring impact that players encounter. A second plurality of interior panels is disposed between individual ones of the first plurality of interior panels and individual ones of the first plurality of exterior panels. The second plurality of interior panels have the same shape as the first plurality of panels but are slightly smaller so that they fill the recesses in the exterior panels that are produced by the stitching. Lastly, a third plurality of interior panels is disposed between the first plurality of interior panels and the bladder. When fully inflated, it is these innermost layer of panels which press outwardly to produce a domed or rounded shape to the outermost (exterior) panels, thus giving the ball better aerodynamic properties and a better gripping surface for the player.

Considered another way, the present invention includes the insertion of an interior set of three layered panels with each layer serving a different purpose. The outermost layer fills the recesses produced by the stitching and provides improved cushioning. The middle layer has peripheral regions which lay over the rigid stitching and thus also provides additional cushioning. The third or innermost layer is disposed against the bladder, which when inflated, pushes against this innermost insert layer and produces exterior panels having rounded or domed shapes. While the description above has been couched in terms of a three layered insert, it is noted that these inserts for each exterior panel may comprise an integral structure. It is also noted that, for these inserts, the middle layer is the widest so that it covers the stitching; the outermost layer is the next smallest so that it fits into the recesses formed by the stitching; the innermost layer is the smallest so that it may most easily press upwardly/outwardly to produce domed shaped exterior/cover panels.

In accordance with another aspect of the present invention adhesive is applied by screen printing along the edges between panels before sewing. Once the ball is complete another coat of epoxy is applied by hand by hand and cured by passage through an infrared oven. The purpose of the first adhesive by screen printing is to strengthen the joints of the exterior panels and the adhesive applied by hand is to further strengthen the stitching and the previously applied screen printed adhesive.

In accordance with yet another aspect of the present invention, it is noted that the ball includes a special exterior panel through which the bladder is attached. This is referred to as the "bladder panel." In one aspect of the present invention, the bladder panel is provided with a fabric layer on top and an EVA foam layer on the bottom. The fabric on top of the special bladder panel that is adhered to the fabric lining that is already present on the exterior cover panel. The bladder panel is inserted so that its fabric adheres to the inner exterior cover fabric. The EVA layer on the bladder panel is adhered to the bladder nozzle through an opening in the exterior cover panel. All three layers are joined by adhesive and are then stitched together with machine sewing for strength.

Accordingly, it is an object of the present invention to produce a soccer ball or similar sports object having improved aerodynamic capabilities.

It is another object of the present invention to produce a soccer ball or similar sports object which is easier for an athlete to grip.

It is yet another object of the present invention to produce a soccer ball or similar sports object having raised or dome shaped exterior panels.

It is a still further object of the present invention to produce a soccer ball or similar sports object having improved strength, durability and which will last exhibit a longer useful life.

It is still another object of the present invention to produce a soccer ball or similar sports object which exhibits greater cushioning.

Lastly, but not limited hereto, it is an even further object of the present invention to improve the manufacturing process for soccer balls and related sports objects.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

FIG. 1 is an exploded view of the three layers which comprise the structure of the outer panels or exterior cover for a soccer ball or the like;

FIG. 11A is a view similar to FIG. 8A except that it is directed to the production of pentagonal panels;

FIG. 11B is a view similar to FIG. 8B except that it is directed to the production of pentagonal panels;

FIG. 11C is a view similar to FIG. 8C except that it is directed to the production of pentagonal panels;

FIG. 12A is a view similar to FIG. 9A except that it is directed to the production of pentagonal panels;

FIG. 12B is a view similar to FIG. 9B except that it is directed to the production of pentagonal panels;

FIG. 13A is a view similar to FIG. 10A except that it is directed to the production of pentagonal panels;

FIG. 13B is a view similar to FIG. 10B except that it is directed to the production of pentagonal panels;

FIG. 34A is a view similar to FIG. 8A except that it illustrates a punching operation that produces (stitching covering) panels 452 which are similar to panels 52 except that they include perforations;

FIG. 34B is a view similar to FIG. 8B except that it illustrates a punching operation that produces (recess filling) panels 454 which are similar to panels 54 except that they include perforations;

FIG. 34C is a view similar to FIG. 8C except that it illustrates a punching operation that produces (dome forming) panels 456 which are similar to panels 56 except that they include perforation;

FIG. 35A is an isometric view similar to FIG. 9A illustrating the step of attaching the panel portion which is intended for placement in the stitching-defined recesses in the outer cover with the exception that the hexagonal panels herein contain perforations;

FIG. 35B is an isometric view similar to FIG. 9B illustrating the step of attaching the panel insert portion which is intended for placement adjacent to the bladder and which functions as a structure which causes rounded or domed cover panels with the exception that the hexagonal panels herein contain perforations;

FIG. 36A is an isometric view similar to FIG. 10 illustrating, from a bottom view, a completed panel having perforations and being a completed insert in accordance with one embodiment of the present invention;

FIG. 36B is an isometric view similar to FIG. 36A except shown from a top view; and FIGS. 37A through 39B are similar to FIGS. 34A through 36B except that they illustrate the production of pentagonal panels.

DETAILED DESCRIPTION

The description provided herein depicts the structure and method for creating a soccer ball. However, it is noted that the present invention is not specifically limited to soccer balls although it finds its most particular utility therein. In general, soccer balls in general have two main structural components: an exterior cover composed of stitched together panels to form and enclosed volume; and an interior inflatable bladder. In the present invention there are additional components disposed between the exterior cover and the inflatable bladder. The description below provides instruction on the use and formation of these additional components.

Figure 1:
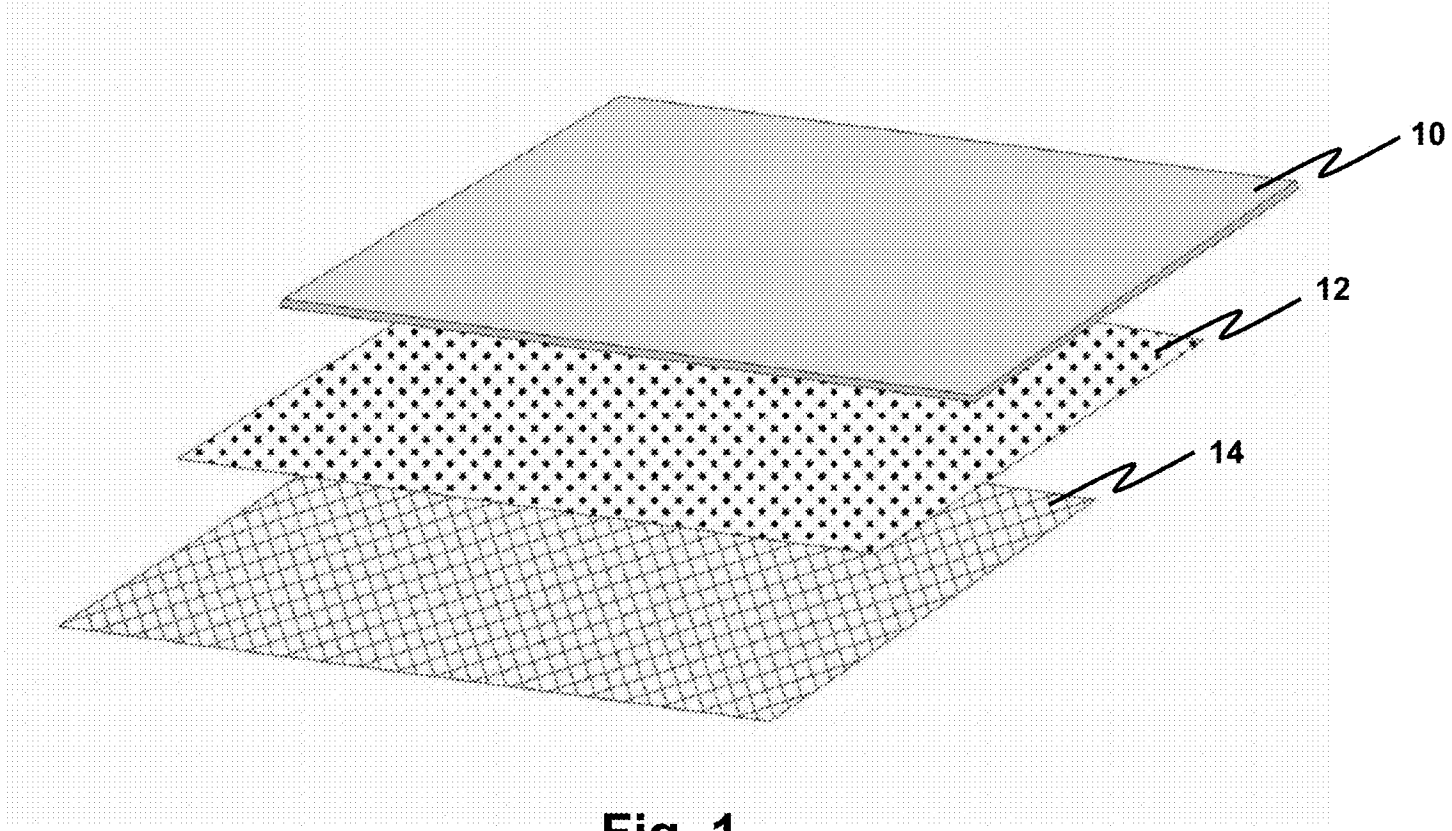

The present description begins with the structure of the exterior covering. As shown in FIG. 1, the outer cover typically comprises three layers. Outer layer 10 comprises any convenient material but typically comprises a material such as leather or any of its newer, man-made equivalents. In general, it is desirable that outer layer 10 comprises a material which is capable of having images imposed on it. These images typically comprise such things as brand names and/or team names. Outer layer 10 preferably comprises material which satisfies the official rules for soccer. Outer layer 10 is typically from 1 mm to 1.5 mm in thickness.

Immediately beneath outer layer 10 there is provided a cellular foam layer 12. This layer is typically approximately 2 mm in thickness. Cellular foam layer 12 is affixed to outer layer 10 using any convenient adhesive material. Lastly, beneath cellular foam layer 12 there is provided fabric layer 14. Fabric layer 14 is likewise affixed to cellular foam layer 12 using any convenient adhesive material. In the construction of soccer balls these three layers typically start out in the form of a single sheet from which variously shaped outer panels (cover panels) are constructed. Together these three layers form the outer cover of the object for sporting play. This object, as previously mentioned, particularly in the case of soccer, is a ball or sphere shaped object. The specific outer cover material is not an essential element of the present invention. What has been described are preferable structures and materials. In accordance with the present invention it is only relevant that the material is amenable to being stitched together in variously shaped panels. Furthermore, with respect to the present invention it is also relevant that the cover material exhibit a certain amount of flexibility so that, inflation of the bladder can produce cover panels having a certain arched or dome structure. It is not essential that the outer cover of the sports object of the present invention comprises three layers. This is merely the preferred embodiment. In short, the present invention is not limited to outer covers having three layers; it is only relevant that the outer layer exhibit a certain degree of flexibility as described herein, to produce domed panels.

The panels of the present invention have three distinct portions: a first layer that fits into recesses caused by stitching which joins adjacent panels; a second intermediate layer that is sufficiently dimensioned in terms of width and area to cover the stitching; and a third layer that is sized and shaped to produce bumpy, dome-shaped outward external panel projections. While the second layer is specifically shaped to cover the stitching, the specific shapes of the first and third layers can be of any desirable shape. It is noted that, while the resultant panels of the present invention are described herein as being composite and formed in layers, the resultant panels may also comprise a uniform (or integral or monolithic) structure. In such cases, references herein to "layers" is better described as being a reference to "levels."

As described above, the present description is directed to the specific construction of soccer balls. As such, as is well known, these balls include outer cover panels having specific geometric shapes. In particular, these panels are found in the form of either hexagons or pentagons. See FIG. 30 and/or 31.

Figure 2:
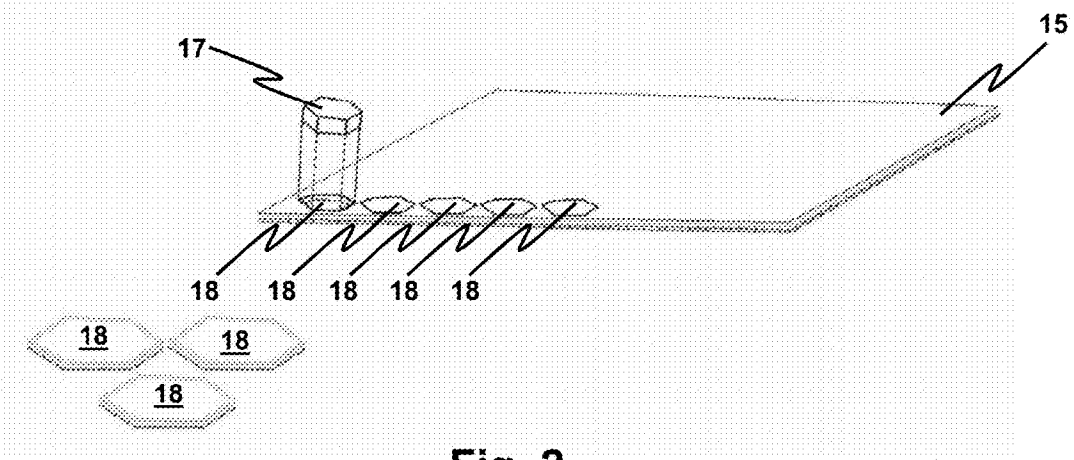
FIG. 2 is an isometric view illustrating a stamping or punching process for producing hexagonal panels for soccer balls.
Figure 3:
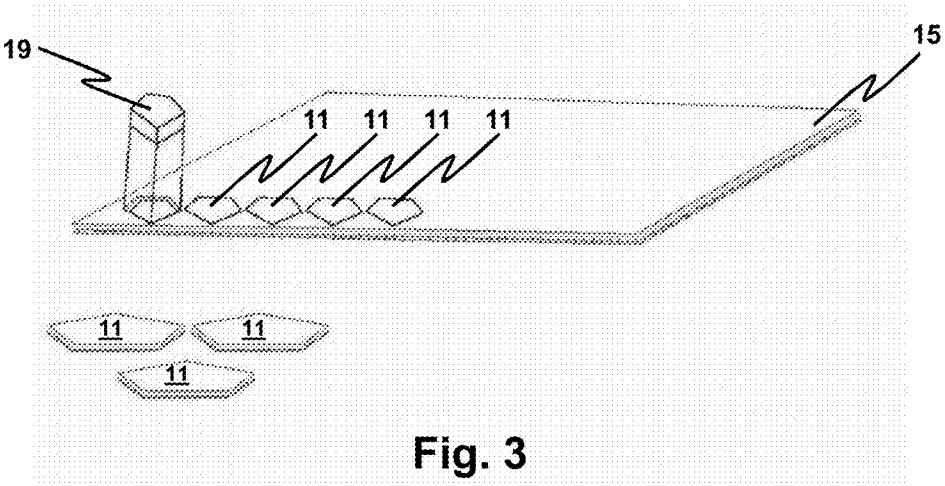
FIG. 3 it is an isometric view illustrating a stamping or punching process for producing pentagonal panels for soccer balls.

Whatever structure and/or material is used for the outer cover, it is typically and initially provided in the form of sheet 15, as seen in FIG. 2. In particular, FIG. 2 illustrates a step in typical soccer ball manufacture in which hexagonal panels for the outer cover are produced. FIG. 2 shows cutting die 17 being used to cut exterior cover panels from sheet 15 in the form of hexagons 18. FIG. 3 illustrates a similar operation being carried out on layer 15 of cover material using cutting die 19 to produce pentagonal shaped outer cover panels 11. It is these panels that are stitched together to produce a sports play object having any desired shape with the pentagon and hexagons shapes being particularly useful in soccer ball manufacture.

Figure 4:
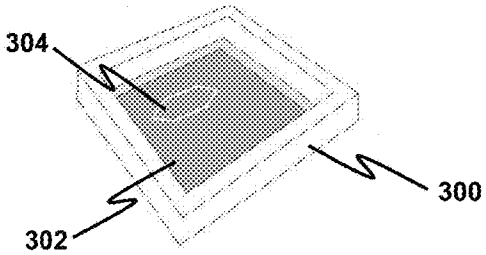
FIG. 4 it is an isometric view illustrating a frame and screen printing device for applying adhesive to panel edges.
Figure 5A:
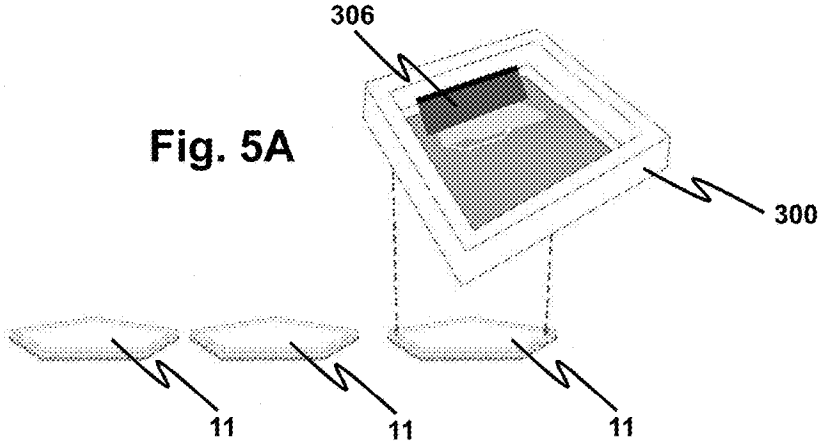
FIG. 5A it is an isometric view of the screen printing apparatus of FIG. 4 used for applying adhesive to pentagonal panels.
Figure 5B:
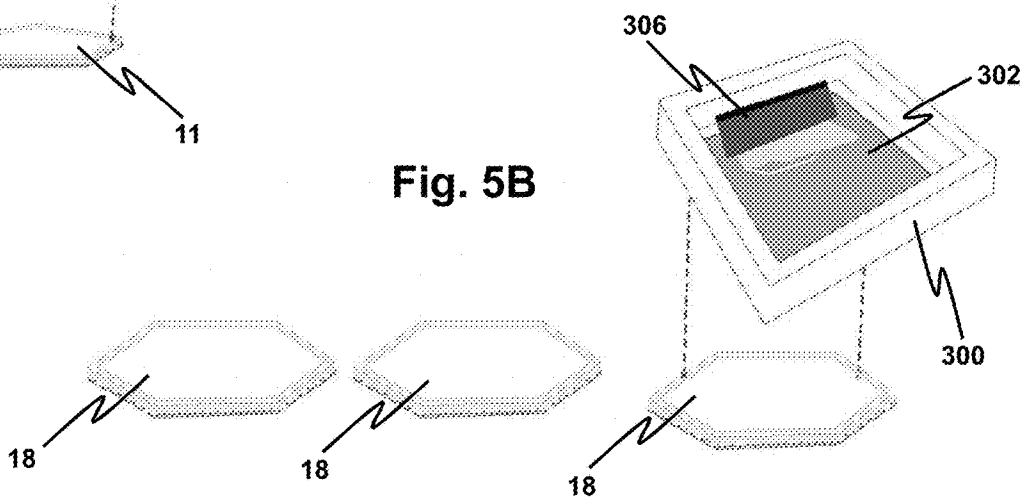
FIG. 5B it is an isometric view of the screen printing apparatus of FIG. 4 used for applying adhesive to hexagonal panels.

In accordance with a preferred embodiment of the present invention, for the purpose of providing extra strength and durability to the resultant structure, a bead or strip of adhesive material is applied to the edges of the outer cover panels. A structure and method for performing the addition of this adhesive is illustrated in FIGS. 4, 5A and 5B. In particular, FIG. 4 illustrates a structure used to apply adhesive in the desired places on an exterior cover panel. Even more particularly, FIG. 4 illustrates the use of frame 300 which includes pattern defining pattern support structure 302 having pattern 304 through which adhesive is applied to exterior cover panels prior to stitching. FIG. 5A illustrates the application of adhesive material to the edges of pentagonal shaped outer cover panels 11. In particular, adhesive is applied to pattern support structure 302, the desired panel is placed beneath the pattern and screed 306 is used to move adhesive material through the pattern and onto the edges of the panel. FIG. 5A particularly shows the application of adhesive material to pentagonally shaped panels 11. FIG. 5B shows a similar process for the application of adhesive material to the edges of hexagonally shaped panels 18.

Figure 6:
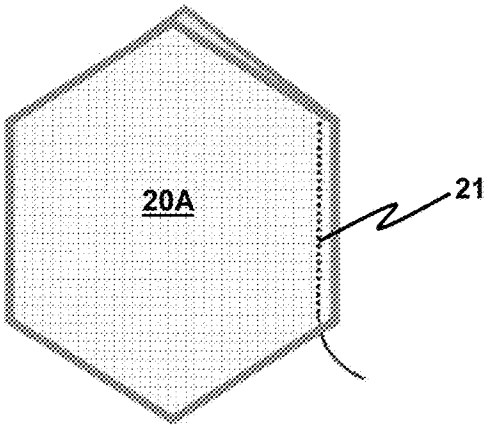
FIG. 6 is a view of a completed hexagonal panel particularly illustrating the location of one of the stitches.

FIG. 6 illustrates the manner in which an initial two panels are stitched together. In particular, FIG. 6 illustrates the stitching together of two hexagonal panels that are initially placed together back to back before stitching 21 is applied. It is noted that, in FIG. 6, fabric layer 14 is visible. The hexagonal panel shown in FIG. 6 is labeled as 20A. In subsequent similar drawings, hexagonal panels include a reference character "A" and pecked diagonal panels include a reference character "B."

Figure 7:
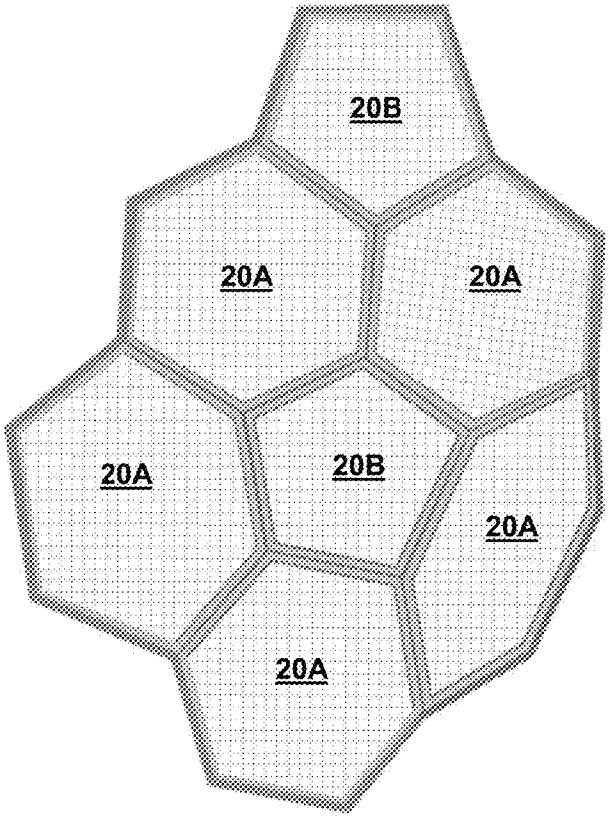
FIG. 7 is a view of the internal portion of a partially assembled soccer ball illustrating the relationship between hexagonal and pentagonal panels particularly in their sewn together configuration.

FIG. 7 illustrates a further step in the process of forming the outer or cover structure for the sports playing object of the present invention. In particular, it illustrates a further step in the construction of a soccer ball. In FIG. 7, there is shown a single pentagonal cover panel 20B which has been stitched together with a surrounding set of hexagonal cover panels 20A. For a more detailed, side view of the stitching, see FIGS. 21 and/or 22.

The stitching operation naturally produces raised areas surrounding each panel. These raised areas at the panel edges produce hexagonal and pentagonal recesses in the outer cover. The stitching also produces ball structures which are hard and not amenable to significant amounts of flexure. These recesses clearly are formed on the interior of the cover layer. An understanding of the location of these recesses is important for understanding some of the other aspects of the present invention. In particular, it is noted that in the present invention there is additionally provided intermediary layer panels which are insertable into these recesses.

In earlier versions of the present invention as set forth in the parent applications listed above, the intermediate layer panels provided different functionality. In one of these embodiments the intermediate layer panel provided cushioning over the raised stitched areas; in another embodiment the intermediate layer panel provided additional opportunities for gel filled openings in the intermediate layer panel. However, and most importantly for understanding the structure, method, advantages and operation of the present invention it should be fully appreciated that the intermediate panels of the present invention include a third layer which is disposed adjacent to the bladder and which operates to shape exterior cover panel portions in a manner which produces exterior panels having an arched or dome structure. It is a structure which provides the advantages seen in at least one aspect of the present invention.

In earlier versions of the present invention as set forth in the parent applications listed above, the intermediate layer panels provide different functionality. In one of these embodiments the intermediate layer panel provides cushioning over the raised stitched areas; in another embodiment the intermediate layer panel provides additional opportunities for gel filled openings in the intermediate layer panel. However, and most importantly for understanding the structure, method, advantages and operation of the present invention, it should be fully appreciated that the intermediate panels of the present invention include a third layer which is disposed adjacent to the bladder and which operates to shape exterior cover panel portions in a manner which produces exterior panels having an arched or dome structure. This is best illustrated in a comparison of FIGS. 21 and 22. It is a structure which provides the advantages seen in at least one aspect of the present invention.

It is noted that, while the intermediate insert panels of the present invention are described above as being produced in the form of a three layered structure, it is also possible to provide the intermediate panels of the present invention in the form of a single, unitary (integral) structure. It is also noted that while the illustrations herein are particularly directed to situations in which the portions of the intermediate panel inserts closest to the bladder exhibit the same peripheral shape as its corresponding panel, that is, either a pentagon or hexagon as in soccer ball construction, it is also possible to provide the inner or lower portion of intermediate panel inserts of the present invention as being discs or other shaped structures. The relevant aspect of the lower or inner portion of the intermediate panel inserts is that they are of a thickness, shape and sufficient rigidity to produce domed or arched exterior cover panels, particularly when the bladder is inflated.

Figure 8C:
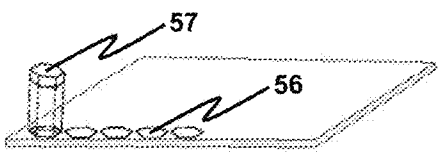
FIG. 8C is an isometric view illustrating the stamping or punching operation associated with the production of the innermost layer portion of inserts usable in accordance with the present invention and which are disposed adjacent to the bladder and are employed primarily to produce rounded (or domed) cover panels.
Figure 8C:
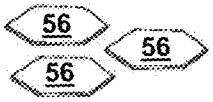
Figure 8B:
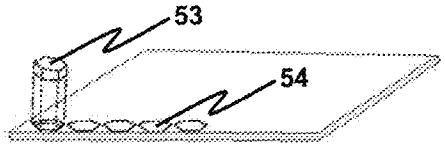
FIG. 8B is an isometric view illustrating the stamping or punching operation associated with the production of the exterior layer portion of inserts usable in accordance with the present invention and which are seated into recesses caused by operations associated with stitching together the outermost or visible cover layer panels.
Figure 8B:
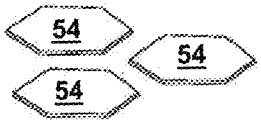
Figure 8A:
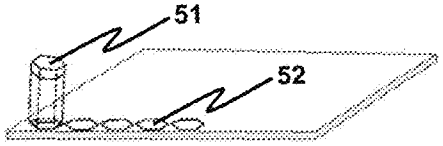
FIG. 8A it is an isometric view illustrating the stamping or punching operation associated with the production of the middle layer portion of inserts usable in accordance with the present invention.
Figure 8A:
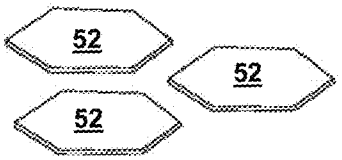
Figure 20:
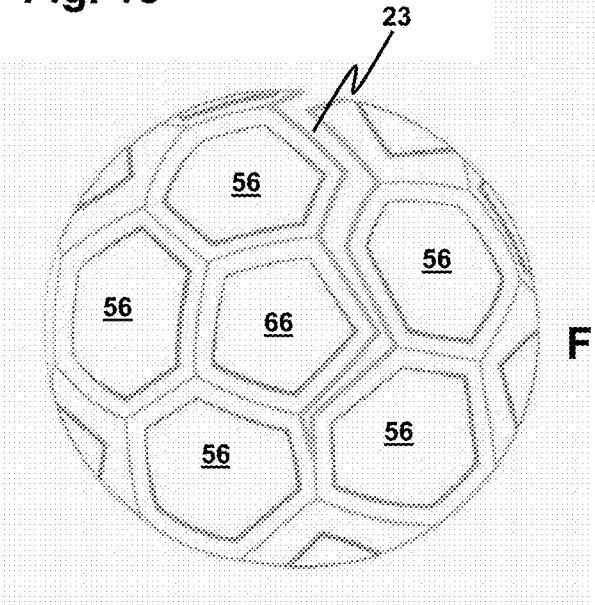
FIG. 20 illustrates an almost completed soccer ball as it exists prior to one of its final stitching operations.
Figure 21:
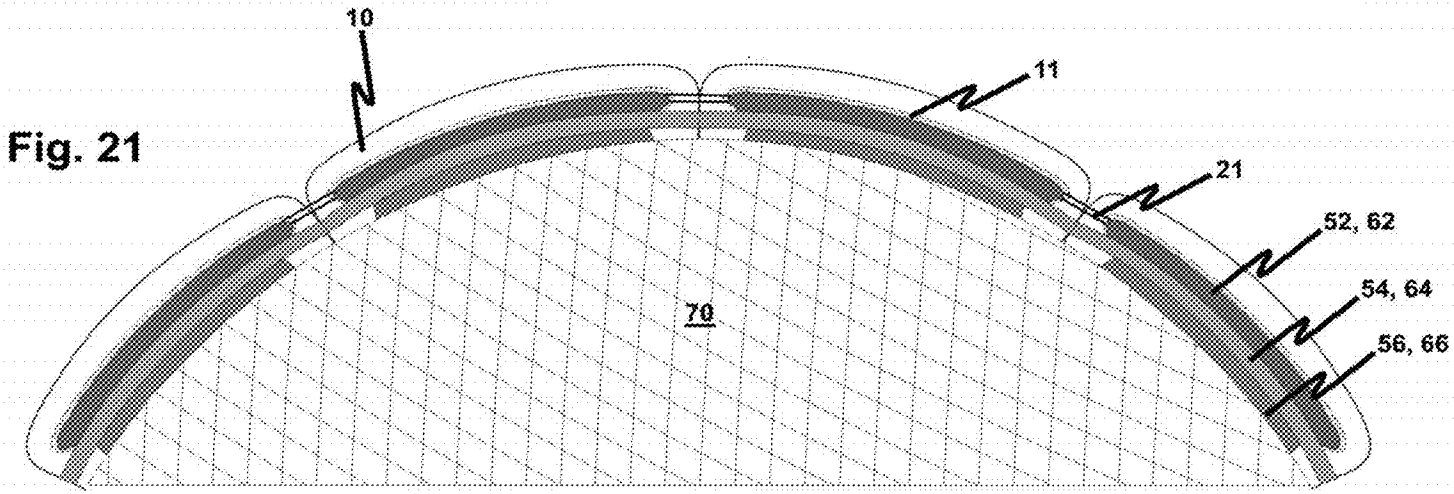
FIG. 21 it is a cross-sectional view illustrating the insert of the present invention and particularly showing its relation to recesses in the outer cover and the inner bladder.

In one manner of producing intermediate layer inserts of the present invention this is done by adhering together three separate layers. The production of these three layers is illustrated in FIGS. 8A, 8B and 8C. These layers are produced from sheets of ethylene-vinyl acetate (EVA), also known as poly (ethylene-vinyl acetate) (PEVA). These intermediate panel layers are provided in three different sizes. FIG. 8A illustrates the production of the largest size; FIG. 8B illustrates the production of the intermediate size; and FIG. 8C illustrates the production of the smallest portion. These are cut out from EVA sheets by means of cutting dies 51, 52 and 57 respectively. In particular, FIGS. 8A-8C illustrate the production of hexagonal panels 52, 54 and 56. Panels 52 are the largest of the three layers and are sized so that their edges meet and extend over the inwardly extending portions of the stitching, as shown in FIGS. 20 and 21. While panel 52 is the largest panel it comprises the middle layer of the intermediate panel inserts of the present invention. Panels 54 are the next largest in size and are intended for placement in the recesses produced by inwardly extending portions of the stitching. Lastly, panels 56, which are most important for the preferred embodiments of the present invention are the smallest of the three layers of each intermediate panel insert. These intermediate panel inserts are intended to be disposed between the bladder and the outer cover, as described above.

Figure 10A:
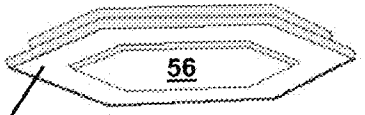
FIG. 10A is an isometric view illustrating a completed insert in accordance with the present invention from a bottom view.
Figure 10B:
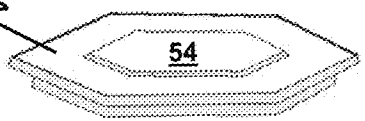
FIG. 10B is a view similar to that shown in FIG. 10B except from a top or upper view.
Figure 9B:
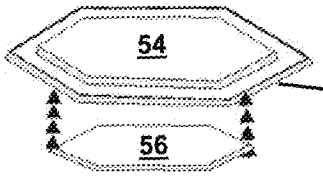
FIG. 9B is an isometric view illustrating the step of attaching the insert portion which is intended for placement adjacent to the bladder and which function as a structure which causes rounded or domed cover panels.
Figure 9A:
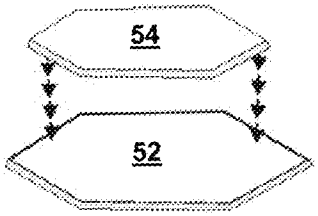
FIG. 9A is an isometric view illustrating the step of attaching the insert portion which is intended for placement in the stitching defined recesses in the outer cover.

FIG. 9A illustrates hexagon 54 being adhered to hexagon 52. In other words, the portion of the intermediate panel insert that sits in the stitching recess is being applied to the intermediate panel insert portion that sits on top of the stitching. FIG. 9B illustrates another step in this process in which the smallest/innermost intermediate panel layer is affixed to the bottom of layer 52 which sits atop the stitching. It is noted that it does not make any difference which of the steps of FIG. 9A or 9B are performed first. FIG. 10A illustrates the result structure as seen from a bottom view. FIG. 10B illustrates the result structure seen from above.

FIGS. 11A, 11B, 11C, 12A, 12B 13A and 13B are similar to the figures described immediately above except that they are directed to the production of panels having a pentagonal shape. The scheme for the reference numerals is perfectly analogous to the previously described drawings.

Figure 14:
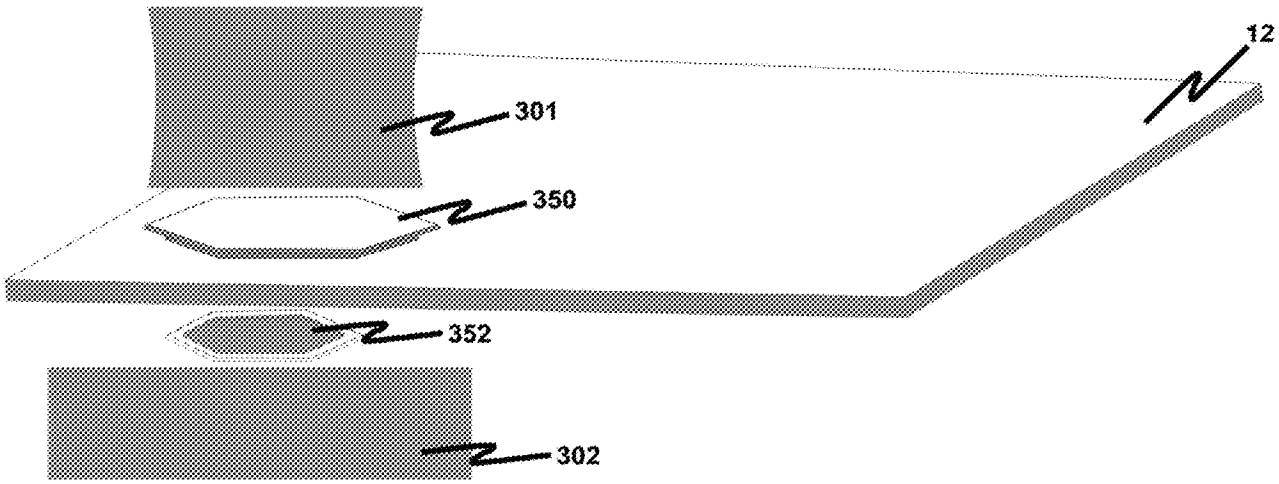
FIG. 14 it is an isometric view of the instrumentality that is used produce hexagonal inserts in accordance with the present invention in which, instead of three adhered layers, the insert comprises an integral structure produced by the shaping die shown.

As described above, the production of the intermediate layer panels of the present invention does not have to occur in three layers which are adhered together in separate operations. The intermediate layer panels are also producible in a single molding operation which results in intermediate panels having a unitary or integral structure. Production of intermediate layer panels in accordance with this latter aspect of the present invention is illustrated in FIG. 14. Production in this method uses the same EVA foam sheet 12' as shown in FIGS. 8A-13B.

Figure 15A:
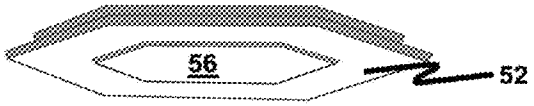
FIG. 15A is an isometric view of the integrally structured insert of the present invention from a bottom view.
Figure 15B:
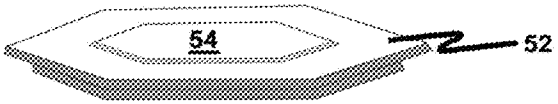
FIG. 15B it is an isometric view of the integrally structured insert of the present invention from a top view.

In a process for creating intermediate layer panels having a unitary structure one begins with EVA foam sheet 12', as shown in FIG. 14. This sheet is disposed between upper shaping die 350 and lower shaping die 352 which sits atop machine bed 302. Operation of HF (high frequency) machine head 301 produces the integral structure shown in FIG. 8A (view from below) and FIG. 15B (view from above).

Figure 16:
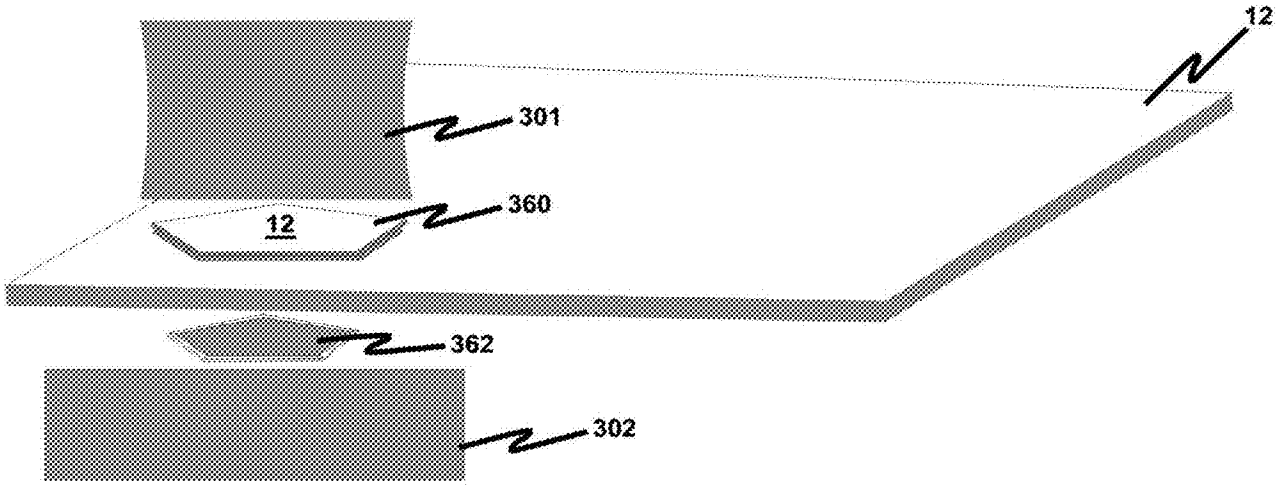
FIG. 16 is a view similar to FIG. 14 except that it is used for the production of pentagonal insert panels.
Figure 17A:
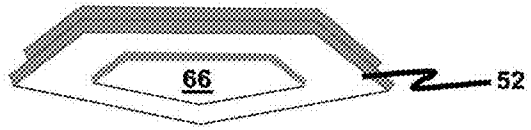
FIG. 17A is a view similar to FIG. 15A except that it illustrates the resultant product, namely, a pentagonal insert from below.
Figure 17B:
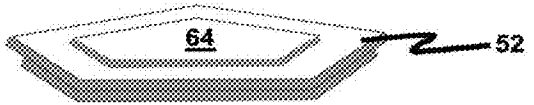
FIG. 17B it is similar to FIG. 15B except that it illustrates the resultant product, namely a pentagonal insert from above.

In an analogous way the production of pentagonally shaped intermediate panels is illustrated in FIGS. 16, 17A and 17B. In FIGS. 15A, 15B, 17A and 17B the structures shown are integral or unitary in nature and construction. Reference numeral selection follows the same pattern as previous drawings.

Figure 19:
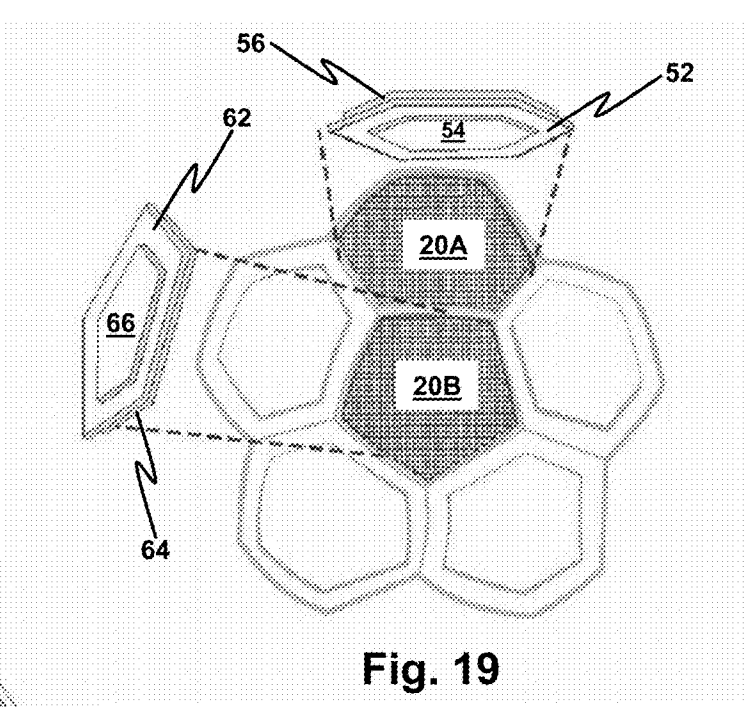
FIG. 19 it is an isometric view illustrating the insertion of one of the inserts of the present invention into its corresponding recess as formed by cover stitching.
Figure 18:
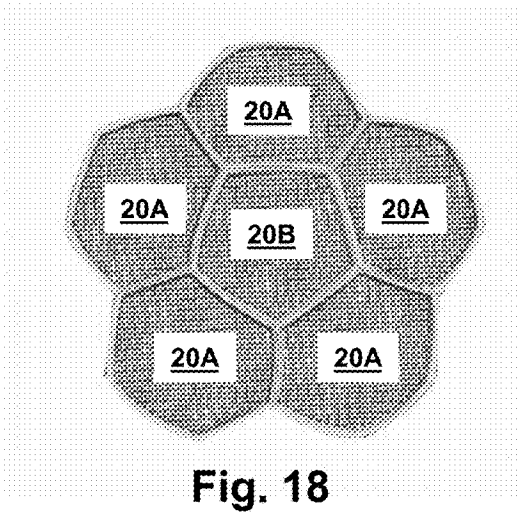
FIG. 18 illustrates a set of hexagonal exterior panels situated around a pentagonal panel which are affixed together by stitching.

FIGS. 18-20 illustrates the process in which the joining together of the exterior panels occurs. Additionally, FIG. 19 illustrates an important aspect of the present invention in which various ones of the intermediate layer panels are inserted into the recesses formed by the stitching. More particularly, FIG. 18 illustrates a portion of assembled exterior panels. In particular, fabric layer 14 is visible. FIG. 18 illustrates a hexagonal panel 20B surrounded by five hexagonal panels 20A.

As indicated above, FIG. 19 represents an important aspect of the present invention in that it illustrates the step in which the intermediate layer panels of the present invention are disposed into the corresponding ones of the recesses formed in the outer/cover layer by the above-described stitching. In particular it illustrates a hexagonal panel from the intermediate layer of the present invention being disposed into a correspondingly shaped hexagonal panel 20A. Note that upper panel portions 54 is disposed adjacent to the outer cover layer. Panel portions 52 is sized and disposed so as to extend over the stitching. Finally, it is seen that panel portions 56 ends up being disposed adjacent to the bladder (not visible in this figure). In a similar fashion it is seen that pentagonal panel having portions 60 to 64 and 66 is inserted into pentagonal panel 20B in the outer/cover layer. In this view, inner portion 66 of the intermediate layer panel insert is seen as being disposed adjacent to the bladder. It is portions 56 and 66 that provide the dome shaped portions of the outer cover, particularly when the bladder is fully inflated.

FIG. 20 illustrates the construction of a soccer ball in accordance with the present invention and a stage prior to attachment of the bladder and inversion. Most notably FIG. 20 illustrates the fact that at this stage of manufacture, the ball being inside out, what shows visibly is pentagonal intermediate layer insert panel portion 66 whom and hexagonal intermediate layer insert panel portion 56. These are the portions of the intermediate layer inserts of the present invention which are visible at this stage of manufacture.

Figure 22:
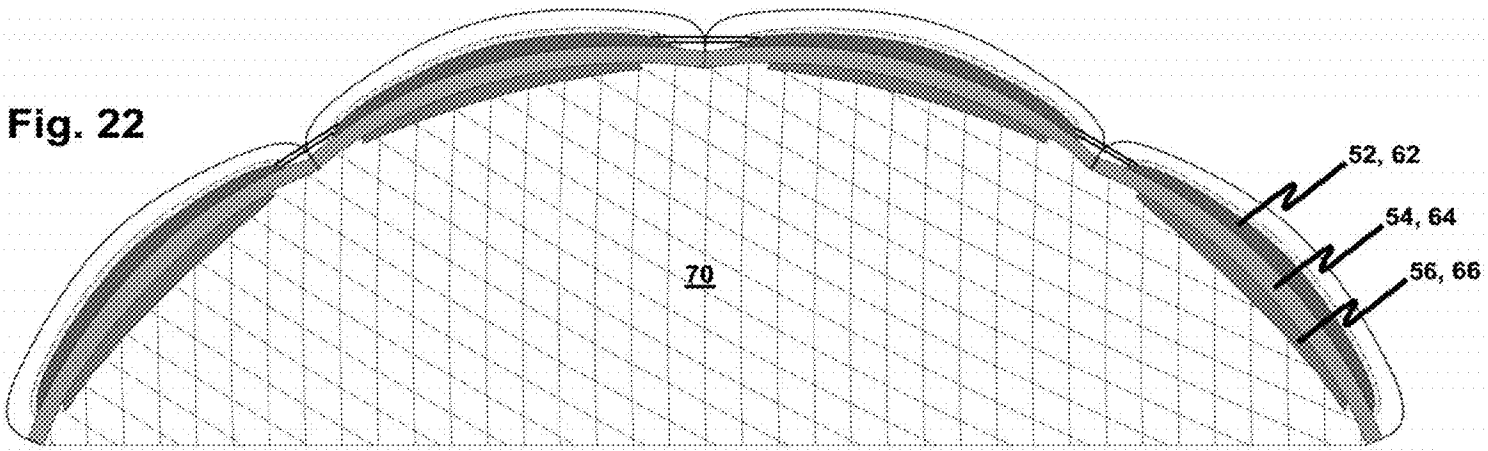
FIG. 22 is a view similar to that shown in FIG. 21 but more particularly showing the resultant desired structure when the bladder is fully inflated.

FIGS. 21 and 22 are similar except that FIG. 22 illustrates a fully inflated soccer ball. It is seen in FIG. 22 that bladder 70 is inflated to a greater degree and extends further outward into spaces shown in FIG. 21. FIGS. 21 and 22 are both cross-sectional views of a completed soccer ball. Reference numeral 10 refers to a panel in the outer cover of the ball. Reference numeral 11 refers to a layer of fabric which is disposed between the intermediate panel layers of the present invention and the outer cover. It is also instructive to note the presence of stitching 21 that extends between adjacent outer cover panels, both hexagonal ones and pentagonal ones. As above, it is seen that lower or inner intermediate panel layer portion 56 or 66 is disposed against bladder 70. Inflation of bladder 70 to a desired degree exerts an outward pressure urging portions 56 and 66 outwardly so as to raise the central portions of cover panels 10. This produces a dome structure in accordance with the present invention. Intermediate layer panel portions 54 and 64 serve the same functions as set forth in one or more of the parent application's namely the covering of stitching so as to provide improved softness and cushioning. Lastly, intermediate layer panel portions 52 and 62 serve similar functions as described in one or more parent applications, namely filling recesses in the outer/cover layer, again to provide increased cushioning. As described elsewhere herein, these recesses are produced by inwardly extending portions of stitching 21.

Figure 23:
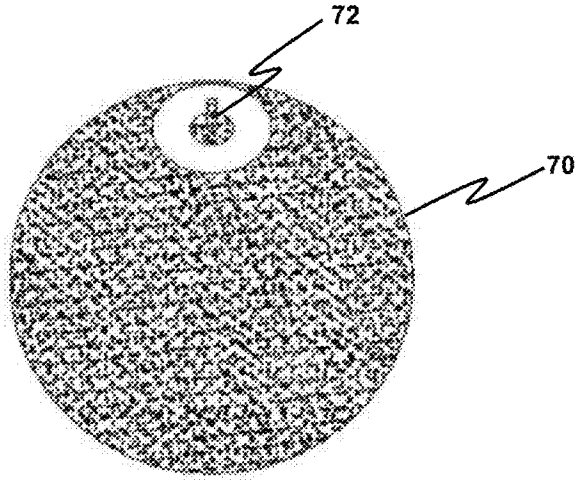
FIG. 23 illustrates the structure of a fully inflated bladder and particularly illustrates the nipple used for infusion of a gas for purposes of inflation.

FIG. 23 illustrates a fully inflated bladder 70 together with nipple 72 used for inflation. Attachment of bladder 70 is illustrated in FIG. 29C and 29F below.

Figure 24:
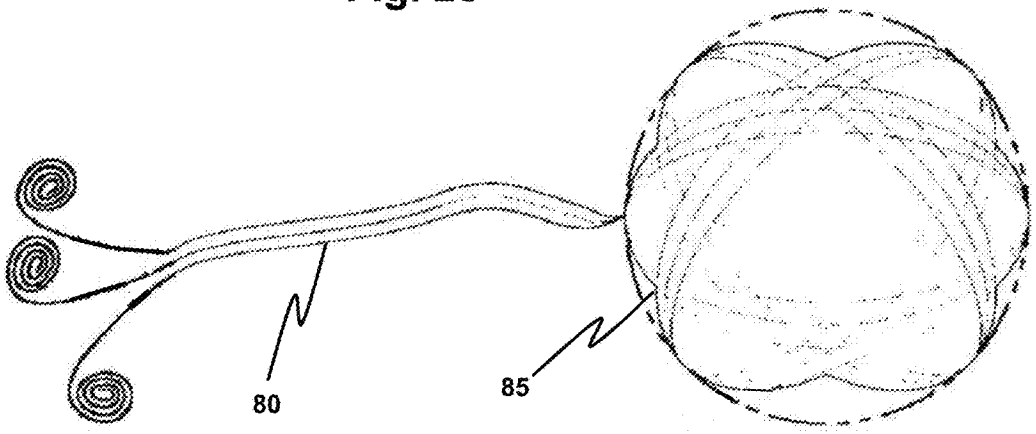
FIG. 24 illustrates the placement of reinforcing thread typically present on the inside of a soccer ball.
Figure 25:
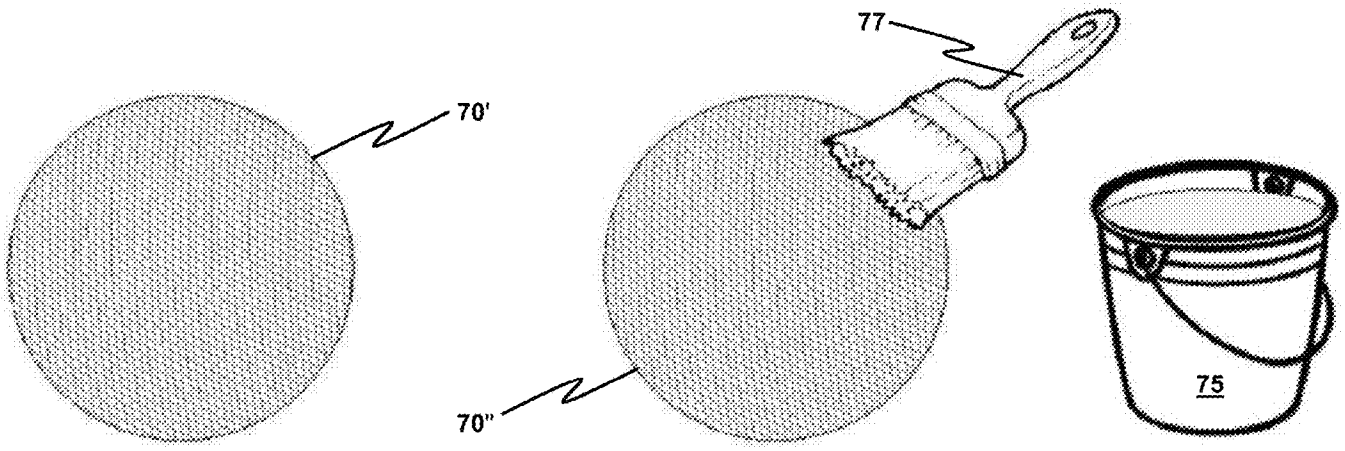
FIG. 25 illustrates the placement of adhesive material on the inflatable bladder for vulcanizing the threads prior to its insertion into an almost complete soccer ball structure.
Figure 26:
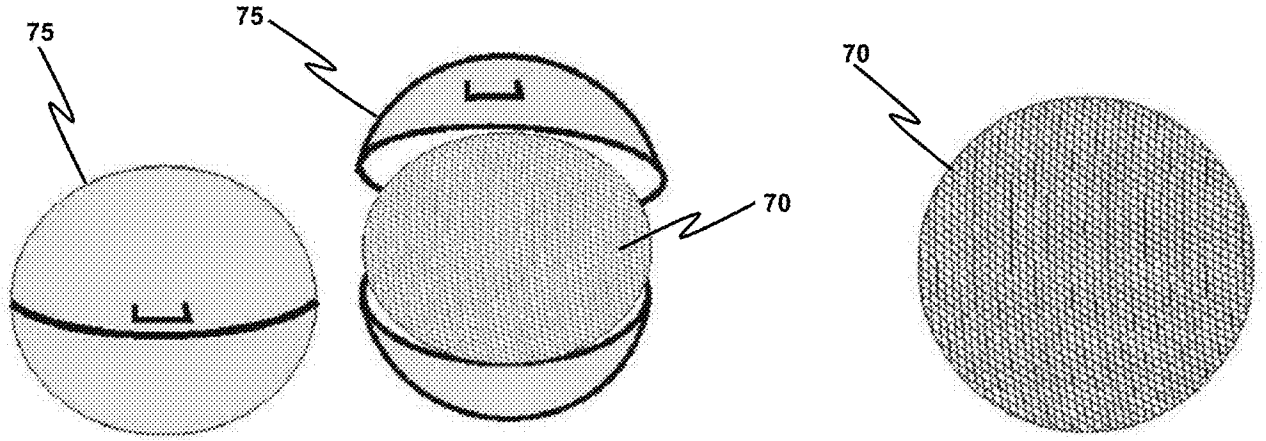
FIG. 26 illustrates the placement of the bladder in a vulcanizing mold.

FIGS. 24 illustrates the manufacture of a bladder which is suitable for use with the present invention. In particular, FIG. 24 illustrates the placement of reinforcing thread 80 in a spherical pattern 85 around bladder 70. FIG. 25 illustrates completely wound bladder 70' just prior to the thread covered bladder being coated with latex from bucket 75 via brush 77 to form coated bladder 70". This bladder is then placed in vulcanizing mold 75 from which is produced bladder 70 which is ready for insertion into a soccer ball. While latex is a preferred adhesive for this step in the process, any convenient vulcanizable polymeric adhesive may be employed. These steps are shown in FIGS. 25 and 26.

Figure 27:
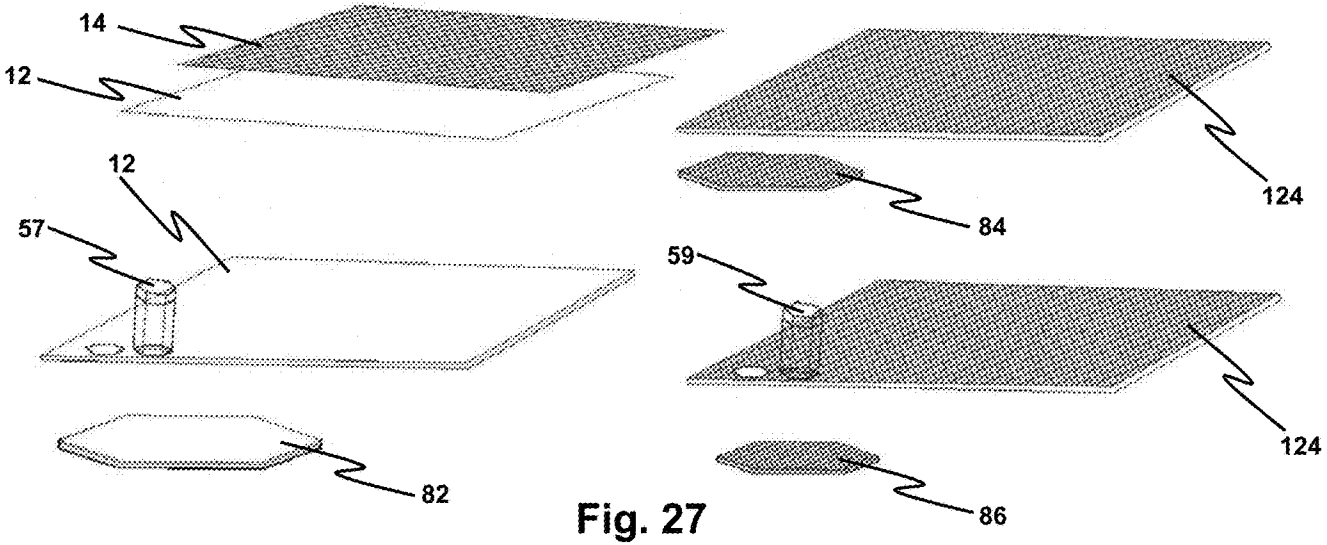
FIG. 27 illustrates the production of the three layers that are particularly associated with the production of the bladder panel.
Figure 28:
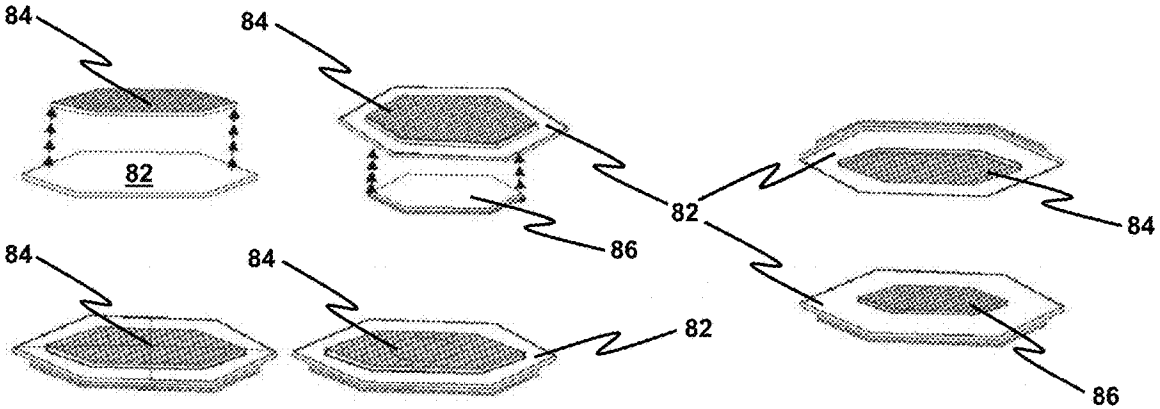
FIG. 28 illustrates the steps that are employed in the assembly, via adhesive, of the panel parts produced by the production stamping apparatus and method illustrated in FIG. 27.

It is first noted that the panel through which bladder nipple 72 is disposed in a typical soccer ball is a hexagonal panel. This is the convention that is generally used, and it is the convention that is illustrated here. However, it is noted that the present invention is not limited to having the inflation nipple disposed in a hexagonal panel. Having said that, it is further noted that FIGS. 27 and 28 are particularly directed to the treatment of whatever panel is used for disposition of the inflation nipple.

Because bladder 70 is relatively heavy, it is often the case that, when the ball is deflated, it falls inside the ball causing problems. An important aspect of at least one embodiment of the present invention is that there is provided a method for affixing bladder 70 to panel 86 in FIG. 29C. In this method, all three layers of the composite panel inserts are joined together by sewing. This bonds all three panel layers together strongly; then adhesive is applied in order to bond bladder 70 to the interior panel fabric; thus, the bladder nozzle is firmly bonded to the panel with adhesive. The present method firmly holds bladder 70 during final assembly. This holds and keeps bladder 70 firmly attached to the bladder panel. When bladder 70 is deflated all of the pressure is focused on the bladder panel because bladder 70 is hanging loose inside.

The intermediate layer panel that is preferably used for the panel for which the air insertion nipple is disposed has a slightly differently desired construction. In particular, it resembles the other intermediate layer panels described herein but further and preferably includes two fabric layers. A single layer of fabric may be employed but two layers are preferred. FIG. 27 illustrates a starting point for the construction of any one of the three layers employed in the particular intermediate layer panel associated with the inflation nipple. In particular, it is seen that one begins with fabric layer 14 which is affixed to EVA layer 12. A hexagonal panel is cut from a layer comprising EVA alone using shaped cutting die 17. This produces hexagonal pattern 82 which comprises the middle layer for the nipple bearing panel for air inflation. It is this layer that does not include fabric and which covers the stitching. As above, the composite panel for air inflation also includes fabric covered panel 84 which lies in the above-mentioned recesses and also includes panel 86 which is disposed adjacent to bladder 70.

For the construction of panels 84 and 86 a combination of layers 12 and 14, here labeled 124 is employed. Using cutting die 59 described above, panel portion 86 is produced. This is the smallest sized portion, similar to portion 56 described above except for the fact that it includes fabric layer 14. Similarly using cutting die 57, panel portion 82 is produced. This is the largest of the three sizes and is employed as an intermediate layer panel. This portion is similar to portion 52 described above except for the fact that it also includes fabric layer 14. The production of these three layers is illustrated in FIG. 27.

FIG. 28 is similar to FIGS. 9A, 9B, 10A and 10 B. However, FIG. 28 is directed to the construction of the specific intermediate level panel insert associated with bladder nipple 72 (not visible at this stage of construction). FIG. 28 shows intermediate sized panel 84, with its fabric layer, being affixed to largest panel portion 82. Subsequently, smallest intermediate sized panel portion 86 is affixed to the other side of panel 82. Upper and lower views of the resultant product are also illustrated in FIG. 28.

Figure 29A:
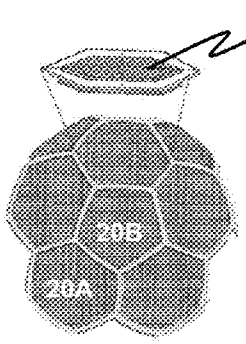
FIG. 29A illustrates the placement of the special insert associated with the bladder panel.
Figure 29B:
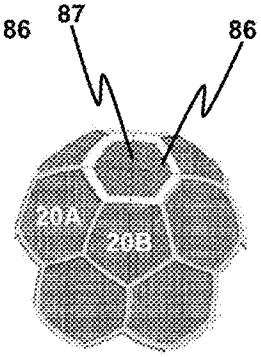
FIG. 29B illustrates a stitching operation that occurs across the bladder panel.
Figure 29C:
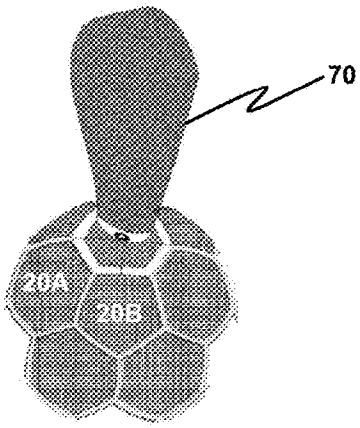
FIG. 29C illustrates the attachment of the bladder to the bladder panel.

FIG. 29A illustrates the placement of an intermediate layer panel reinforced with fabric being placed in a panel location used for air nipple placement. FIG. 29B illustrates this panel in place prior to bladder attachment. FIG. 29C illustrates the attachment of bladder 70. It is noted that in FIG. 29B there are present threads 87 running across the panel used for attachment of bladder 70.

Figure 29D:
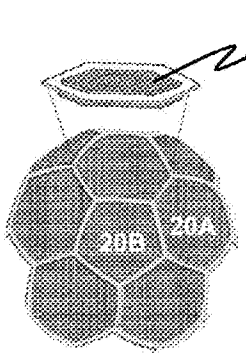
FIG. 29D is similar to FIG. 29A except that it is associated with a slightly different stitching process for the bladder panel.
Figure 29E:
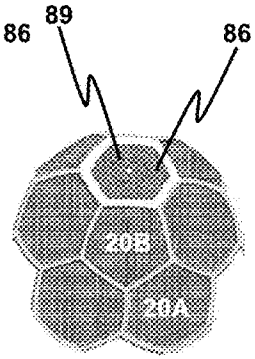
FIG. 29E illustrates a stitching operation that occurs around the exterior bladder opening.
Figure 29F:
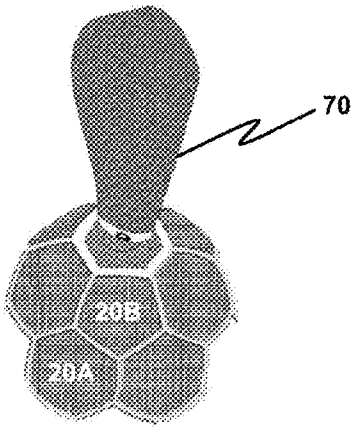
FIG. 29F also illustrates the attachment of the bladder to the bladder panel.

FIGS. 29D, 29E and 29F are similar to FIGS. 29A, 29B and 209C except for the details associated with bladder attachment. More particularly it is seen in these latter figures that attachment is effected by means of circular stitching 89.

Figures 30, 31:
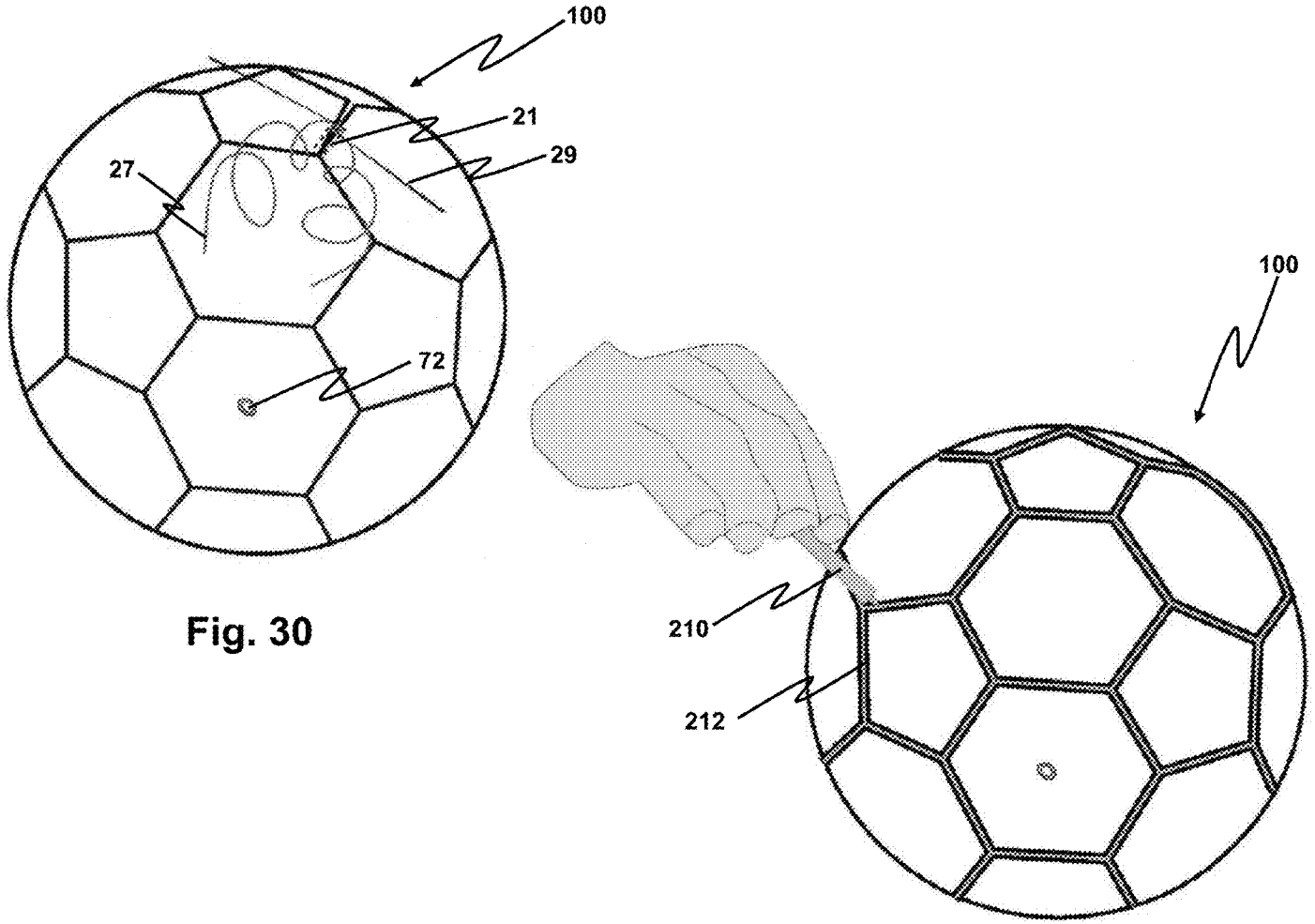
FIG. 30 illustrates closure of the final seam in soccer ball manufacture after turning the ball's exterior part inside-out.
FIG. 31 illustrates the application of adhesive material to exterior seams.

FIG. 30 illustrates the final sewing together of the last two panels. This occurs after attachment of the bladder and in version of the almost completed ball. In particular, FIG. 30 illustrates stitching 21 as shown in some of the other figures along with air nipple 72. Also shown in FIG. 30 are thread 27 and needle 29 is for carrying out this final assembly operation.

Figure 32:
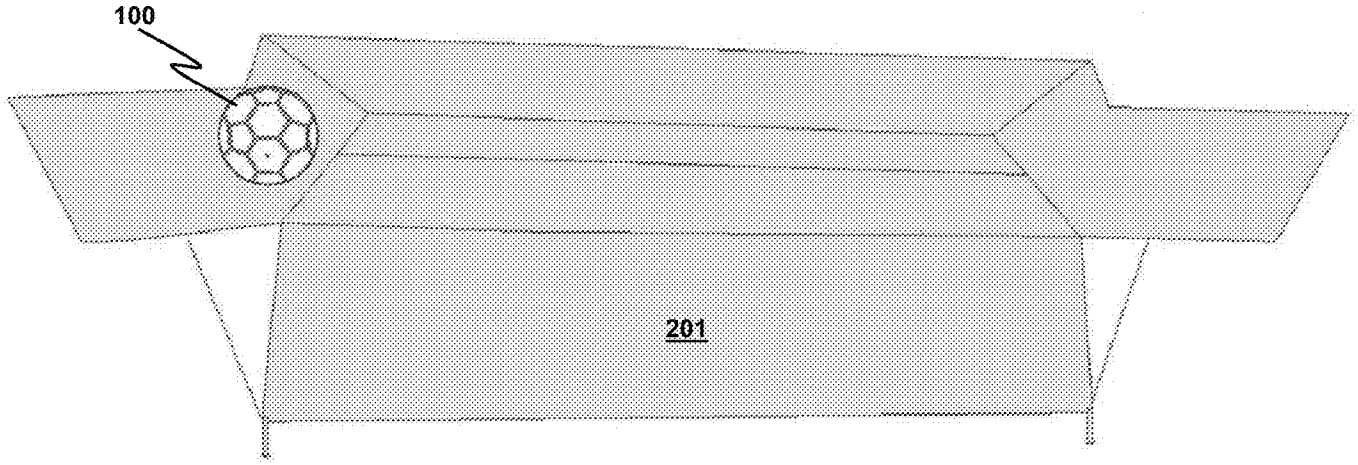
FIG. 32 illustrates the entry of a soccer ball into an infrared oven for the purpose of curing adhesive material applied as shown in FIG. 31.
Figure 33:
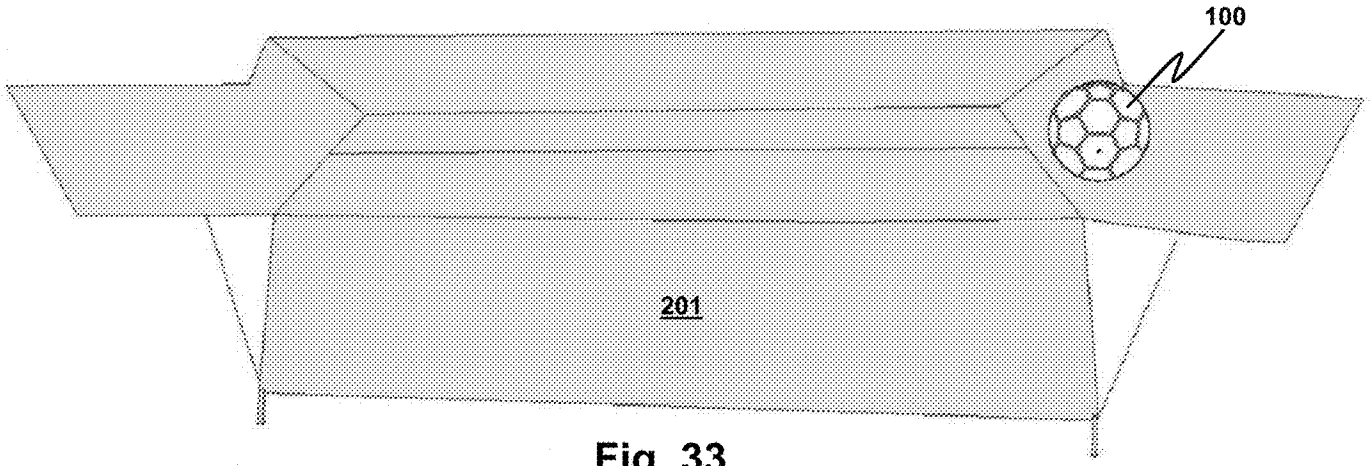
FIG. 33 illustrates the exit of the soccer ball from the infrared oven.

In accordance with one embodiment of the present invention, the soccer ball is further provided with adhesive 210 for strengthening purposes. This adhesive is applied along the seams 212 in the almost final product 100. Lastly for purposes of curing the adhesive, ball 100 is passed through infrared heating unit 201 as shown in FIGS. 32 and 33.

In the event that the use of adhesive materials either prior to or after stitching operations, adds an undesirable amount of weight to a ball, it is possible to offset this effect by using panels that are perforated. For example, FIG. 34A Illustrates cutting die 451 being used to cut hexagonal panels 452 with perforations in place from foam sheet 15. The operation shown in FIG. 34A. In particular, cutting dies 451 produces the middle panel with the perforations already in place. In a similar fashion, FIG. 34B illustrates the production of mid-sized panel portions (the portions intended for placement in the stitching-defined recesses). Cutting die 453 produces midsized panel portion 454. In a similar manner cutting die 455 produces panel portion 456 (producing dome formation), the smallest (in terms of width or area) of the three layers that make up a completed panel for insertion.

FIG. 35A illustrates a step of attaching a recess filling panel portion to a stitching overlapping panel portion. FIG. 35B illustrates a step of attaching a dome forming panel portion to a stitching overlapping panel portion. It is noted that these steps may be performed in any order. The resultant structure is shown in FIGS. 36A (view from the bottom) and 36B (view from the top).

FIGS. 37A through 39B are similar to FIGS. 34A through 36B except that they illustrate the production of pentagonal panels. As immediately above, die/cutter 461 produces pentagonal panel 462 having perforations therethrough for use as a stitching covering panel portion. Likewise, die/cutter 463 produces pentagonal panel 464 having perforations therethrough for use as a recess filling panel insert portion. Lastly, die/cutter 465 produces pentagonal panel 466 having perforations therethrough for use as a dome forming panel insert portion. These three pentagonal panel portions are assemblable in the same manner as the hexagonal panel portions, above, as shown in FIGS. 38A through 39B.

It is noted that the description herein is directed at methods for producing soccer balls but is not limited thereto. It is also noted that, as above, panel inserts of the present invention may also comprise integral structures such as those produced in accordance with the method shown in FIGS. 16, 17A and 17B. Stamping dies are then used to produce perforations as shown in FIGS. 34A through 39B.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 USC § 112, sixth paragraph, unless the element is expressly recited using the phrase "means for."

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. An object for sports play comprising:

a plurality of exterior, stitched together panels sewn at their edges, configured to form a closed volume and forming, by said stitching, raised interior edges at the edges of said panels, whereby each panel has associated therewith a recessed area essentially coextensive with said panel and defined by said raised interior edges;

an inflatable bladder occupying said closed volume;

a first plurality of interior panels disposed between said bladder and said exterior panels, said first plurality of interior panels being essentially coextensive with said respective recessed areas and abutting one another at their edges directly beneath said stitching;

a second plurality of interior panels disposed between said first plurality of interior panels and said first plurality of exterior panels, said second plurality of interior panels being disposed within said respective recessed areas: and a third plurality of interior panels discontinuously disposed between said first plurality of interior panels and said bladder, said third plurality of interior panels being essentially coextensive with said respective recessed areas, whereby said exterior panels are urged outward upon inflation of said bladder.

2. The object for sports play of claim 1 in which said first, second and third plurality of interior panels individually comprise a unitary structure.

3. The object for sports play of claim 1 in which there is a layer of fabric disposed exterior to said second plurality of interior panels.

4. The object for sports play of claim 1 in which said bladder contains sufficient gaseous content to produce dome shaped exterior panels.

5. The object for sports play of claim 1 in which said stitched together panels are also affixed to one another by adhesive.

6. The object for sports play of claim 1 in which said inflatable bladder is affixed to a reinforced panel.

7. The object for sports play of claim 1 in which said stitched together panels comprise pentagonal and hexagonal shapes.

8. The object for sports play of claim 1 in which there is a reinforcing layer disposed over said inflatable bladder.

9. The object for sports play of claim 1 in which said plurality of exterior, stitched together panels comprise a multilayered structure.

* * * * *